United States Patent [19]

Gustafsson et al.

[11] Patent Number: 4,876,074

[45] Date of Patent: Oct. 24, 1989

[54] METHOD FOR SEPARATING ZINC OUT OF A HOT GAS CONTAINING ZINC VAPOUR

[75] Inventors: Bengt O. Gustafsson, Falun; Nils B. Johansson, Hofors, both of Sweden

[73] Assignee: SKF Plasma Technologies AB, Hofors, Sweden

[21] Appl. No.: 245,424

[22] Filed: Sep. 16, 1988

[30] Foreign Application Priority Data

Oct. 12, 1987 [SE] Sweden ..... 8703930
Mar. 23, 1988 [SE] Sweden ..... 8801058

[51] Int. Cl.[4] ..... B01D 47/00; B01D 19/00
[52] U.S. Cl. ..... 423/210.5; 55/72
[58] Field of Search ..... 423/210.5; 55/72

[56] References Cited

U.S. PATENT DOCUMENTS 3,928,550 12/1975 Seitzer ..... 55/72
4,548,621 10/1985 Eriksson et al. ..... 55/72

FOREIGN PATENT DOCUMENTS 359667 7/1974 United Kingdom ..... 55/72

*Primary Examiner*—Gregory A. Heller

*Attorney, Agent, or Firm*—Armstrong, Nikaido, Marmelstein, Kubovcik & Murray

[57] ABSTRACT

To separate zinc out of a hot gas containing zinc vapour, a flow of lead is circulated in counterflow to the gas in a condenser. Heat from the lead flow from the condenser is transmitted to a chamber from which lead is transferred to the condenser. The lead flow from the condenser is cooled in known manner to a temperature at which its zinc saturation solubility is lower than its zinc content, thus causing precipitatioin of the zinc. The precipitated zinc is then separated off. The cooled flow of lead, poor in zinc, is transferred to the chamber for heating by the heat transmitted thereto so that the lead flow heated in this way and supplied to the condenser acquires a zinc saturation solubility higher than its zinc content. An apparatus for putting the method into effect comprises a lead-circulation circuit including a condenser, a cooling channel and means for separating zinc out of the lead, and has the lead-circulation circuit upstream of the condenser provided with a lead chamber with means being arranged to transmit heat from the lead flow leaving the condenser to the lead, poor in zinc, flowing through the chamber.

9 Claims, 2 Drawing Sheets

METHOD FOR SEPARATING ZINC OUT OF A HOT GAS CONTAINING ZINC VAPOUR

Figure 1:
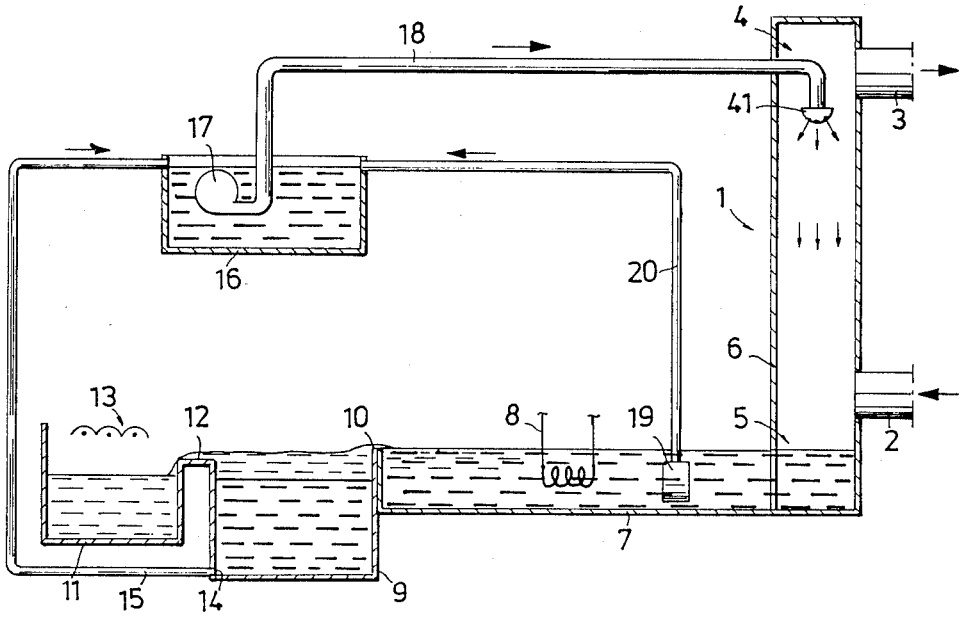

The present invention relates to a method of separating zinc out of a hot gas containing zinc vapour, the hot gas being conducted through a gas cooler where the zinc vapour is condensed on a flow of liquid lead which is cooled for separation of the zinc and then recirculated. The invention also relates to apparatus for performing the method.

It is well known to condense zinc vapour in lead and subsequently to cool the lead so that its zinc saturation solubility is lower than its zinc content. The zinc is thus precipitated out and can be separated from the liquid lead.

When the zinc has been removed, the lead is recirculated for renewed contact with zinc vapour, thus maintaining a continuous process during circulation of the lead flow.

The hot gas containing the zinc vapour may also include small particles of iron. In this case hard zinc may be formed in the gas cooler/condenser if lead which is *saturated with zinc* comes into contact with the hot gas containing these particles of iron. It is also important that the lead flow supplied to the gas cooler/-condenser is able to dissolve zinc immediately without having to be first heated by the hot gas. It is of course possible to heat the lead flow for this purpose but the energy and installation costs would be considerable.

The present invention provides a method and apparatus for a continuous process for separating zinc out of a hot gas containing zinc vapour, using a gas cooler in which the zinc vapour is condensed on a flow of lead which is able to dissolve zinc immediately it enters the counterflow gas cooler, without external thermal energy having to be supplied to the circulating lead flow.

The present invention therefore provides a method in which heat from the lead flow coming from the gas cooler is transmitted to a chamber, from which lead is transferred to the gas cooler, the lead flow from the gas cooler is cooled in known manner to a temperature at which its zinc saturation solubility is lower than its zinc content so that zinc is precipitated out and the precipitated zinc is separated, and that the cooled lead flow, poor in zinc, is transferred to the chamber to be heated by the heat transmitted thereto, the lead flow heated in this way and supplied to the gas cooler, thus acquiring a zinc saturation solubility higher than its zinc content.

The method according to the invention is thus particularly useful for separating zinc out of a hot gas containing zinc vapour and possibly also a small quantity of iron particles. Usually such hot gas also contains a small quantity of lead vapour and for this reason also it may be advisable to use lead as condensing material. However, it must be evident that other metals or liquids corresponding functionally to lead in the relevant technology shall be considered equivalent to lead and thus also encompassed by the invention.

In the following specific embodiment of the invention, described by way of example, it is important that the lead contains less than its saturation content of zinc upon entering the condenser, usually in counterflow to the hot gas flowing from a furnace shaft, for instance, since a certain amount of extraneous matter, such as small particles of iron, accompany this hot gas flow and a troublesome alloy, i.e. hard zinc, might be formed in the condenser if zinc-saturated lead encountered the iron particles. Of course, absorption of the zinc into the lead is also facilitated according to the invention if the lead entering the condenser can immediately dissolve the zinc without first having to be heated by the hot gas containing the zinc.

The zinc precipitated out by cooling of the lead flow floats to the surface of the lead and can be separated. The separation process is advantageously performed in flotation pools and the second partial flow of lead, poor in zinc, is removed from the bottom of the pool in a manner ensuring that a minimum of precipitated zinc accompanies it.

According to one embodiment of the invention the heat is transmitted by transferring a first partial flow of the lead flowing to the gas cooler, to the chamber which thus becomes a mixing chamber.

According to a second embodiment the heat is transmitted via a heat exchanger from the flow of lead leaving the gas cooler.

An apparatus for performing the method comprises a lead-circulating circuit including a condenser, said condenser being provided with a gas inlet and a gas outlet, and also with an inlet and an outlet for the lead flow, the condenser preferably being in the form of a counterflow condenser, a lead cooler being included in the lead-circulation circuit located downstream of the condenser, and a zinc-separating means being connected to the cooler. According to the invention the lead-circulating circuit upstream of the gas cooler is provided with a lead chamber and means are arranged for the transmission of heat from the lead flow leaving the cooler, to the lead chamber to heat the lead therein to a temperature ensuring that the lead leaving the chamber has a zinc saturation solubility higher than its zinc content.

Figure 2:
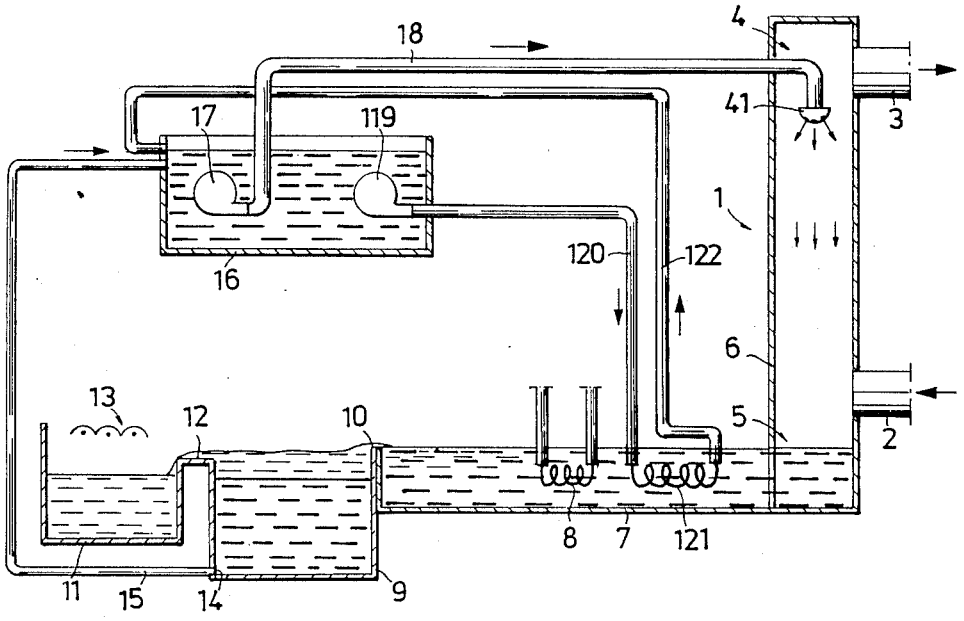

The invention will now be described in more detail by way of example with reference to the accompanying drawings. FIG. 1 shows schematically a first apparatus for performing the method according to the invention. FIG. 2 shows schematically a second apparatus for performing the method according to the invention.

Gas containing zinc vapour and a small quantity of lead vapour is introduced by an inlet 2 in the lower part of a cooling tower or condenser 1, flowing up through the condenser and out through an outlet 3. Liquid lead is supplied via a pipe 18 at the top of the condenser 1 and is atomized in a centrally located distributor 41.

The upwardly flowing gas is cooled by the shower of lead from about 1100° C. to 500°-550° C. The zinc vapour is condensed on the lead drops and dissolves in the lead. The lead vapour in the gas also condenses on the colder lead drops. The cooled gas, with the zinc and lead vapour removed, is withdrawn through outlet 3 which is located above the centrally placed distributor 41. The lead, heated to 540°-550° C. by the heat content of the gas and the condensation heat of the zinc and lead, is removed from the bottom of the cooling tower 1 through a gate located below the surface of the lead, so that a gas lock is obtained. The lead then flows along a cooling channel 7 where the condensor dross is immediately removed by a machine, not shown. The dross may then continue to a separator where fine drops of lead in the dross can be separated and returned to the cooling channel 7. The lead leaving the condensor 1 has a zinc content of about 2.2-2.3% and a temperature of 540°-550° C. The saturation solubility for zinc in lead at 540° C. is about 3.6% and the lead flowing out of the condensor 1 is thus some way from being saturated with zinc. An overflow threshold 10 is provided at an end of the cooling channel 7 some way from the lead outlet 5 from the cooling tower, this threshold defining the flow direction for the lead along the channel 7. Cooling means 8 are located along the flow path, for instance in the form of a heat-exchanger which has coolant flowing through it, immersed in the lead flow in the channel 7. The lead flowing past the coolers 8 is cooled to 450° C. and then flows over the threshold 10 into a separation pool 9. Since the saturation solubility of zinc in lead at 450° C. is about 2%, and the lead entering the cooling channel through outlet 5 of the condensor still contains 2.2–2.3% zinc, zinc will be precipitated out, floating to the surface of the lead flow at the outflow end of the cooling channel 7 and then on into the separation pool 9 where the zinc will run over an overflow edge 12 into a holding furnace 11 containing heating members to keep the zinc at a temperature of 470° C. The zinc can then be removed and cast into ingots. The lead is removed through a gate 14 at the bottom of the separation pool 9, and passes yet another threshold (not shown in the drawing) designed to maintain a constant level in the separation pool 9.

The lead running over the threshold from the separation pool has a temperature of 450° C. and a zinc content of about 2% and is thus saturated with zinc. This lead is conveyed via a pipe 15 to a mixing chamber 16.

In the cooling channel, upstream of the cooling means 8 and downstream of the condensor's gas lock, a shunt by-pass 20 is connected to the lead flow to transfer a portion thereof to the mixing chamber 16. A pump means 19 can be utilized for this purpose. The partial flow transferred via shunt by-pass 20 may be about one third, for instance about 30–35% of the flow of lead through the condensor 1.

Lead saturated with zinc and having a temperature of 450° C. conveyed to the mixing chamber 16 via pipe 15 is mixed with lead not saturated with zinc and having a temperature of about 540 20 –550° C. supplied to chamber 16 via shunt by-pass 20. With the above stated Flow ratio via pipes 15 and 20 the mixture in chamber 16 acquires a temperature of about 480° C. and a zinc content of about 2.1%. The saturation solubility for zinc in lead at 480° C. is about 2.45%. Thus the pump means 17, shown schematically, will supply a flow of lead which is not saturated with zinc, from the chamber 16, via pipe 18, to the top of the condensor cooling tower 1. This is important since the gas entering via inlet 2 and deriving from a furnace shaft may include a small quantity of iron particles so that hard zinc would be formed in the condensor 1 if zinc-saturated lead encountered the iron particles. Furthermore, the absorption of zinc in lead is of course facilitated by the lead which is pumped in via nozzle 41 being able to dissolve zinc immediately, without first having to be heated by the gas flow.

The gas leaving the furnace shaft and entering via inlet 2 may have a zinc content of about 7% and in the apparatus under consideration, the gas leaving through outlet 3 may have a temperature of about 500° C., in which case the zinc content is less than 0.1%.

The apparatus shown in FIG. 2 corresponds in most respects with the apparatus according to FIG. 1 and the identical features are identified with the same reference numerals. However, pump 19 and shunt by-pass 20 in the apparatus shown in FIG. 1 have been replaced by the pump 119 in chamber 16, the heat-exchanger 121 upstream of the cooler 8 and downstream of the cooling tower 1, and pipes 120 and 122 connecting the heat-exchanger 121 to the pump 119 and chamber 16, respectively. Pipes 15 and 122 have their orifices in the same part of the chamber 16 and the pump 17 is located between said part of the chamber and the pump 119. In the apparatus according to FIG. 2, lead is pumped by pump 119 from the chamber 16 (a pump sump), through pipe 120 and through the heat-exchanger 121 (shown schematically) which is immersed in channel 7 downstream of the condensor 1, where lead having a temperature of 540°–550° C. is passing. The quantity of lead pumped through the heat-exchanger 121 is about 30–35% of the total flow of lead through the condensor 1. The lead leaving the condensor 1, maintaining said temperature of 540°–550° C., heats the cooler lead being pumped from chamber 16 via pipe 120 through the heat-exchanger 121, to a temperature of about 530° C., and is thus cooled to 520°–530° C. before reaching the cooling loops 8 at the beginning of the actual cooling portion of the channel. The lead flowing out of the heat-exchanger 121, passes along the pipe 122 back to the pump sump 16 to be mixed with the lead arriving via pipe 15 with a temperature of about 450° C. The mixture of lead from pipes 122 and 15 will thus have a temperature of about 470° C. and the zinc content is still only 2.0%. The saturation zinc content in lead at 470° C. is 2.3%. The lead pumped into the condensor 1 via pipe 18 is thus rather far from being saturated with zinc.

Pump 119 which pumps lead to the heat-exchanger 121 is placed at a distance from the mixing zone for the flows from pipes 122 and 15. Pump 119 will thus pump lead having a temperature of 470° C. and which is not saturated with zinc, to the heat-exchanger 121. Pump 119 is so located because it is difficult to pump zinc-saturated lead since the zinc is easily frozen on the pipes exposed to air between the pump sump 16 and heat-exchanger 121. Zinc attacks on pump and pipes to the heat-exchanger 121 are also minimized. Zinc-saturated lead has a corrosive effect on steel components.

One advantage of using heat-exchanging as described in the embodiment according to FIG. 2, as compared with pumping hotter lead down to the pump sump in accordance with the embodiment shown in FIG. 1, is that some hard zinc particles are present in the lead leaving the condensor 1. When the hot lead is pumped to the cooler lead in the pump sump 16, some of these particles will accompany the lead into the condensor 1 and the hard zinc may reduce- the ability of the lead to dissolve zinc. In the embodiment according to FIG. 2, however, i.e. using a heat-exchanger, all lead will pass the separation pool 9 where a considerable proportion of the hard zinc particles will be separated out. The lead pumped into the condensor 1 will therefore be purer.

We claim:

1. A method for separating zinc from a hot gas containing zinc vapour, the gas being conducted through a gas cooler where the zinc vapour is condensed on a flow of liquid lead which is recirculated and cooled for separation of the zinc, wherein heat from a lead flow coming from said gas cooler is transmitted to a chamber from which lead is introduced into said gas cooler; wherein the lead flow from the gas cooler is cooled to a temperature at which the concentration of zinc exceeds the solubility of zinc in the lead so that zinc is precipitated and the precipitated zinc is separated by density; and wherein the cooled lead flow, low in zinc, is transferred to said chamber to be heated by heated lead transmitted thereto, and the lead flow heated in the way is introduced into said gas cooler, thus acquiring a zinc saturation solubility in excess of its zinc content.

2. A method according to claim 1, wherein the heat is transmitted to said cooled lead by transferring a portion of the lead flowing to the gas cooler, to said chamber which thus constitutes a mixing chamber.

3. A method according to claim 2, wherein the portion of lead flowing to said chamber comprises 30–35% of the total lead flow through the gas cooler.

4. A method according to claim 1, wherein said heat is transmitted by lead from the chamber being circulating through a heat-exchanger which is in contact with the flow of lead leaving the gas cooler.

5. A method according to claim 4, wherein the lead is removed from the chamber at a position where the lead is at a temperature such that it is not saturated with zinc.

6. A method according to claim 4 or 5 wherein the lead flow through the heat exchanger comprises 30–35% of the total lead flow through the gas cooler.

7. A method according to claim 1 where the temperature of the lead leaving the chamber is about 470°–480° C.

8. A method according to claim 1, wherein the temperature of the lead downstream of said gas cooler is about 450° C.

9. A method according to claim 1, wherein the temperature of the lead which is introduced into said gas cooler is about 480° C.

* * * * *

UNITED STATES PATENT AND TRADEMARK OFFICE

Certificate

Patent No.: 4,876,074 Patented: Oct. 24, 1989

On petition requesting issuance of a certificate of correction of inventorship pursuant to 35 USC 256, it has been found that the above-identified patent, through error and without any deceptive intent, improperly sets forth the inventorship. Accordingly, it is hereby certified that the correct inventorship of this patent is:
Bengt Olov Gustafsson, Nils Borje Johansson and Sven Santen.

Signed and Sealed this Seventeenth Day of April, 1990.

JOHN J. DOLL

*Supervisory Primary Examiner*
*Patent Examining Group 110*